US010273758B2

(12) United States Patent
Evans et al.

(10) Patent No.: US 10,273,758 B2
(45) Date of Patent: Apr. 30, 2019

(54) CUTTING ELEMENTS COMPRISING A LOW-CARBON STEEL MATERIAL, RELATED EARTH-BORING TOOLS, AND RELATED METHODS

(71) Applicant: Baker Hughes Incorporated, Houston, TX (US)

(72) Inventors: Kenneth R. Evans, Spring, TX (US); Steven W. Webb, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 341 days.

(21) Appl. No.: 15/204,146

(22) Filed: Jul. 7, 2016

(65) Prior Publication Data

US 2018/0010397 A1 Jan. 11, 2018

(51) Int. Cl.
*E21B 10/573* (2006.01)
*B22F 5/00* (2006.01)
(Continued)

(52) U.S. Cl.
CPC ..... *E21B 10/5735* (2013.01); *B22F 5/00* (2013.01); *B22F 7/04* (2013.01); *B22F 7/06* (2013.01); *B24D 18/0009* (2013.01); *C21D 6/001* (2013.01); *C21D 6/007* (2013.01); *C21D 6/02* (2013.01); *C21D 9/22* (2013.01); *C22C 26/00* (2013.01); *C22C 33/0285* (2013.01); *C22C 38/00* (2013.01); *C22C 38/08* (2013.01); *C22C 38/12* (2013.01); *C22C 38/14* (2013.01); *E21B 10/55* (2013.01); *E21B 10/567* (2013.01); *B22F 2005/001* (2013.01); *B22F 2007/045* (2013.01); *B22F 2998/10* (2013.01);
(Continued)

(58) Field of Classification Search
CPC ..... E21B 10/573
See application file for complete search history.

(56) References Cited

U.S. PATENT DOCUMENTS 4,621,031 A 11/1986 Scruggs
4,861,673 A * 8/1989 Hara ..... B22F 7/06 428/469
(Continued)

FOREIGN PATENT DOCUMENTS

JP 05104308 A 4/1993
KR 100800498 B1 2/2008
WO 2015038687 A1 3/2015

OTHER PUBLICATIONS

International Search Report for International Application No. PCT/US2017/040242 dated Oct. 18, 2017, 3 pages.
(Continued)

*Primary Examiner* — Robert E Fuller
(74) *Attorney, Agent, or Firm* — TraskBritt

(57) ABSTRACT

A method of forming a cutting element comprises disposing diamond particles in a container and disposing a metal powder on a side of the diamond particles. The diamond particles and the metal powder are sintered so as to form a polycrystalline diamond material and a low-carbon steel material comprising less than 0.02 weight percent carbon and comprising an intermetallic precipitate on a side of the polycrystalline diamond material. Related cutting elements and earth-boring tools are also disclosed.

20 Claims, 5 Drawing Sheets

(51) Int. Cl.

| | |
|---|---|
| ***B22F 7/04*** | (2006.01) |
| ***B24D 18/00*** | (2006.01) |
| ***E21B 10/55*** | (2006.01) |
| ***B22F 7/06*** | (2006.01) |
| ***C22C 26/00*** | (2006.01) |
| ***C22C 33/02*** | (2006.01) |
| ***C22C 38/00*** | (2006.01) |
| ***E21B 10/567*** | (2006.01) |
| ***C22C 38/08*** | (2006.01) |
| ***C22C 38/12*** | (2006.01) |
| ***C22C 38/14*** | (2006.01) |
| ***C21D 6/00*** | (2006.01) |
| ***C21D 6/02*** | (2006.01) |
| ***C21D 9/22*** | (2006.01) |
| *C22C 29/06* | (2006.01) |

(52) U.S. Cl.
CPC .. *C21D 2211/004* (2013.01); *C21D 2211/008* (2013.01); *C21D 2251/00* (2013.01); *C22C 29/06* (2013.01)

(56) References Cited

U.S. PATENT DOCUMENTS

| | | | | |
|---|---|---|---|---|
| 6,083,570 | A * | 7/2000 | Lemelson | A63C 1/30 427/249.14 |
| 7,048,081 | B2 | 5/2006 | Smith et al. | |
| 7,533,739 | B2 | 5/2009 | Cooley et al. | |
| 7,604,073 | B2 | 10/2009 | Cooley et al. | |
| 7,845,436 | B2 | 12/2010 | Cooley et al. | |
| 7,942,218 | B2 | 5/2011 | Cooley et al. | |
| 7,987,931 | B2 | 8/2011 | Cooley et al. | |
| 8,061,452 | B2 | 11/2011 | Cooley et al. | |
| 8,079,431 | B1 | 12/2011 | Cooley et al. | |
| 8,210,285 | B2 | 7/2012 | Cooley et al. | |
| 8,286,735 | B1 | 10/2012 | Cooley et al. | |
| 8,499,859 | B1 | 8/2013 | Cooley et al. | |
| 8,528,670 | B1 | 9/2013 | Cooley et al. | |
| 8,561,728 | B2 | 10/2013 | Cooley et al. | |
| 8,597,387 | B2 | 12/2013 | Webb | |
| 8,651,204 | B2 | 2/2014 | Webb | |
| 8,689,913 | B2 | 4/2014 | Cooley et al. | |
| 8,763,727 | B1 | 7/2014 | Cooley et al. | |
| 8,931,582 | B2 | 1/2015 | Cooley et al. | |
| 8,973,684 | B1 | 3/2015 | Cooley et al. | |
| 9,091,132 | B1 | 7/2015 | Cooley et al. | |
| 9,279,294 | B1 | 3/2016 | Cooley et al. | |
| 9,303,460 | B2 | 4/2016 | Schwefe et al. | |
| 2005/0210755 | A1 * | 9/2005 | Cho | B21C 3/025 51/293 |
| 2009/0092823 | A1 | 4/2009 | Webb et al. | |
| 2010/0314176 | A1 * | 12/2010 | Zhang | E21B 10/573 175/383 |
| 2013/0146366 | A1 | 6/2013 | Cheng et al. | |
| 2014/0231151 | A1 | 8/2014 | Matthias et al. | |
| 2014/0231161 | A1 | 8/2014 | Lehti et al. | |
| 2015/0233188 | A1 | 8/2015 | Wright, II et al. | |
| 2015/0322727 | A1 | 11/2015 | Do et al. | |
| 2016/0067785 | A1 | 3/2016 | Wang et al. | |

OTHER PUBLICATIONS

International Written Opinion for International Application No. PCT/US2017/040242 dated Oct. 18, 2017, 5 pages.

* cited by examiner

CUTTING ELEMENTS COMPRISING A LOW-CARBON STEEL MATERIAL, RELATED EARTH-BORING TOOLS, AND RELATED METHODS

TECHNICAL FIELD

Embodiments of the disclosure relate generally to cutting elements including a low-carbon steel material, to related earth-boring tools and related methods. More particularly, embodiments of the disclosure relate to cutting elements including a superhard material and a low-carbon steel material on at least one side of the superhard material, to related cutting elements including low-carbon steel on a side of a superhard material, and to related downhole tools and methods.

BACKGROUND

Earth-boring tools are commonly used for forming (e.g., drilling and reaming) wellbores in earth formations. Earth-boring tools include, for example, rotary drill bits, coring bits, eccentric bits, bicenter bits, reamers, underreamers, and mills.

Different types of earth-boring rotary drill bits are known in the art including, for example, fixed-cutter earth-boring rotary drill bits (also referred to as "drag bits"), roller-cone earth-boring rotary drill bits (also referred to as "rock bits"), superabrasive-impregnated bits, and hybrid bits (which may include, for example, both fixed-cutters and rolling cutters). Fixed-cutter bits include a plurality of cutting elements that are fixedly attached to a bit body of the drill bit. Roller-cone earth-boring bits may include a plurality of cutting elements mounted to one or more cones thereof.

The drill bit is coupled, either directly or indirectly, to an end of what is referred to in the art as a "drill string," which comprises a series of elongated tubular segments connected end-to-end that extends into the wellbore from the surface of the formation. Often, various tools and components, including the drill bit, may be coupled together at the distal end of the drill string at the bottom of the wellbore being drilled. This assembly of tools and components is referred to in the art as a "bottom hole assembly" (BHA).

The drill bit may be rotated within the wellbore by rotating the drill string from the surface of the formation, or the drill bit may be rotated by coupling the drill bit to a downhole motor, which is also coupled to the drill string and disposed proximate the bottom of the wellbore. The downhole motor may comprise, for example, a hydraulic Moineau-type motor having a shaft, to which the drill bit is attached, that may be caused to rotate by pumping fluid (e.g., drilling mud or fluid) from the surface of the formation down through the center of the drill string, through the hydraulic motor, out from nozzles in the drill bit, and back up to the surface of the formation through the annular space between the outer surface of the drill string and the exposed surface of the formation within the wellbore.

The cutting elements used in earth-boring tools often include polycrystalline diamond compact (often referred to as "PDC") cutting elements, which are cutting elements that include a polycrystalline diamond (PCD) material. Such polycrystalline diamond compact cutting elements are formed by sintering and bonding together relatively small diamond grains or crystals under conditions of high pressure and high temperature, typically in the presence of a metal solvent catalyst (such as cobalt, iron, nickel, or alloys or mixtures thereof) to form a layer or "table" of polycrystalline diamond material on a cutting element substrate. These processes are often referred to as high-pressure, high-temperature (of "HPHT") processes. The metal solvent catalyst material may be partially dispersed within and between the compacted diamond grains prior to HPHT sintering or during sintering processes to promote diamond-tip-diamond bonding, and to harden and strengthen the compacted diamond powder table.

Upon formation of a diamond table using the HPHT process, a fraction of the metal solvent catalyst material may remain in interstitial spaces between the grains of diamond in the resulting polycrystalline diamond table. The presence of the metal solvent catalyst material in the diamond table may contribute to thermal damage therein when the cutting element is heated by friction during use.

To overcome such problems, so called "thermally stable" polycrystalline diamond compacts (which are also known as thermally stable products, or "TSPs") have been developed. Such a thermally stable polycrystalline diamond compact may be formed by leaching the metal solvent catalyst material (e.g., cobalt) out from interstitial spaces between the inter-bonded diamond crystals in the diamond table using, for example, an acid or combination of acids (e.g., aqua regia). A substantial amount of the metal solvent catalyst material may be removed from the diamond table, or metal solvent catalyst material may be removed from only a portion thereof. Thermally stable polycrystalline diamond compacts in which substantially all metal solvent catalyst material has been leached out from the diamond table have been reported to be thermally stable up to temperatures of about twelve hundred degrees Celsius (1,200° C.). However, responsive to exposure to temperatures exceeding such temperatures, the polycrystalline diamond compact may degrade (e.g., graphitize).

BRIEF SUMMARY

Embodiments disclosed herein include downhole tools including cutting elements comprising a low-carbon steel material, as well as to related methods. For example, in accordance with one embodiment, a method of forming a cutting element comprises disposing diamond particles in a container, disposing a metal powder on a side of the diamond particles, and sintering the diamond particles and the metal powder so as to form a polycrystalline diamond material and a low-carbon steel material, the low-carbon steel material comprising less than 0.02 weight percent carbon and comprising an intermetallic precipitate on a side of the polycrystalline diamond material.

In additional embodiments, a cutting element comprises a polycrystalline diamond material and a low-carbon steel material comprising less than about 0.02 weight percent carbon on at least a side of the polycrystalline diamond material, the low-carbon steel material comprising at least one machined surface.

In further embodiments, an earth-boring tool comprises a bit body including at least one blade and at least one cutting element mechanically attached to the bit body. The at least one cutting element comprises a polycrystalline diamond material and a low-carbon steel material comprising less than about 0.02 weight percent carbon on at least one side of the polycrystalline diamond material.

DETAILED DESCRIPTION

Figure 1:
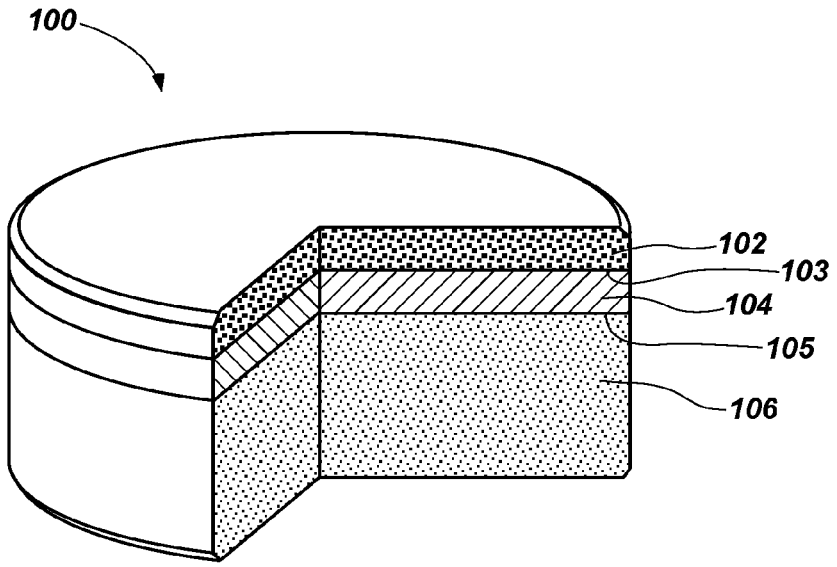
FIG. 1 is a partially cut-away perspective view of a polycrystalline diamond compact cutting element, in accordance with embodiments of the disclosure.

Illustrations presented herein are not meant to be actual views of any particular material, component, or system, but are merely idealized representations that are employed to describe embodiments of the disclosure.

As used herein, the term "drill bit" means and includes core bits, roller-cone bits, fixed-cutter bits, eccentric bits, bicenter bits, reamers, or other earth-boring tools.

As used herein, the term "low-carbon steel" means and includes a ferrous material having a carbon content of about 0.02 weight percent (about 200 ppm) or less, such as less than about 0.02 weight percent, less than about 0.015 weight percent, less than about 0.01 weight percent, or even less than about 0.005 weight percent. Low-carbon steel may include a maraging steel material.

As used herein, the term "maraging steel" means and includes a low-carbon martensitic steel material including nickel that may be heat treated to include intermetallic precipitates. Despite its low carbon content, the maraging steel material may be annealed to form an austenitic structure and slowly cooled (such as by air cooling) to form a martensitic structure. In other words, even though the maraging steel includes a low carbon content, the maraging steel material may be cooled to form a martensitic structure. Maraging steel may include secondary alloying elements, such as cobalt, molybdenum, titanium, aluminum, manganese, or niobium. The secondary alloying elements may be added to produce the intermetallic precipitates, which may be formed by thermal aging (i.e., precipitation hardening) of the maraging steel material. The maraging steel material may be aged after annealing thereof. Aging the maraging steel material may substantially harden the maraging steel material, while maintaining ductility and toughness. Due to its low carbon content, maraging steel may be easier to machine than conventional carbon steel materials. In particular, maraging steel may be easier to machine while in a soft state, prior to aging the maraging steel material. The maraging steel may undergo substantially little dimensional change after being aged. Accordingly, the maraging steel may be machined to a final size and shape while in a soft state and prior to aging thereof. Furthermore, cracks in bodies formed of maraging steel may be negligible or nonexistent. Maraging steel may be strong and tough, yet malleable.

Cutting elements including at least a portion of a hardened low-carbon steel material (e.g., a maraging steel material), as well as earth-boring tools including one or more of such cutting elements, and related methods are described. Cutting elements described herein may include a superhard material, such as particles of diamond. In some embodiments, the superhard material may be in contact with a first side of a substrate. A second, opposing side of the substrate may be in contact with a low-carbon steel material, such as a maraging steel material. The cutting elements may be formed by placing a powder comprising particles of the superhard material in contact with a first side of the substrate in a container. A powder having a composition of the low-carbon steel material may be disposed on and in contact with a second, opposing side of the substrate. The powders may be sintered to form a cutting element comprising a table of the superhard material supported by the substrate, wherein the substrate is disposed between the table and the low-carbon steel material. In other embodiments, the low-carbon steel material may directly contact the superhard material and the cutting element may not include a substrate material. While in a soft state, the low-carbon steel material may be machined to form one or more of threads, one or more flats, one or more slots, or other mechanical structure to facilitate attachment of the cutting element to, for example, a bit body of an earth-boring rotary drill bit. After machining the low-carbon steel material to a desired final size and shape, the low-carbon steel material may be annealed and aged (i.e., precipitation hardened, also referred to in the art as "age hardened") to harden and strengthen the low-carbon steel material. The low-carbon steel material may be annealed and aged at temperatures such that the superhard material does not substantially degrade (e.g., graphitize).

FIG. 1 is a simplified cross-sectional view of a cutting element 100. The cutting element 100 may include a table of superhard material such as a polycrystalline diamond material 102 overlying a substrate 104. The polycrystalline diamond material 102 may comprise a hard polycrystalline compact diamond (PCD) material. The polycrystalline diamond material 102 may directly overlie and contact the substrate 104, such as at a first surface 103 of the substrate 104.

The substrate 104 may include a material that is relatively hard and resistant to wear. For example, the substrate 104 may be formed from and include a ceramic-metal composite material (which are often referred to as "cermet" materials). The substrate 104 may include a cemented carbide material, such as tungsten carbide, tantalum carbide, vanadium carbide, niobium carbide, chromium carbide, titanium carbide, or combinations thereof. In some embodiments, the substrate 104 comprises tungsten carbide particles cemented together in a metallic binder. The metallic binder material may include, for example, cobalt, nickel, iron, or alloys and mixtures thereof. For example, the substrate 104 may include a generally cylindrical body of cobalt-cemented tungsten carbide material, although substrates of different geometries and compositions may also be employed.

The substrate 104 may directly overlie and contact a low-carbon steel material 106, such as at a second surface 105 of the substrate 104 opposite the first surface 103. In other words, the substrate 104 may be disposed directly between the polycrystalline material 102 and the low-carbon steel material 106. In some embodiments, the substrate 104 may be disposed directly between and directly contact the polycrystalline material 102 and the low-carbon steel material 106.

The low-carbon steel material 106 may comprise a material that may be machined (i.e., shaped) while in a soft state prior to completion of the cutting element 100, and may be heat treated after machining thereof to harden the low-carbon steel material 106. In some embodiments, the low-carbon steel material 106 comprises a material that may be annealed and aged at substantially low temperatures such that the polycrystalline material 102, the substrate 104, or both are substantially unchanged responsive to exposure to the annealing and aging process.

In some embodiments, the low-carbon steel material 106 comprises a material that may be annealed and aged (e.g., hardened) at a temperature less than about 900° C., such as between about 450° C. and about 900° C. It is believed that annealing and aging the low-carbon steel material 106 at substantially low temperatures (e.g., less than about 900° C.) does not substantially affect the polycrystalline diamond material 102. By way of nonlimiting example, responsive to exposure to temperatures of greater than about 1,200° C., diamond grains of a diamond table may react with a metal solvent catalyst material (e.g., cobalt) causing the diamond crystals to chemically breakdown or convert to another allotrope of carbon. In some instances, responsive to exposure to excessive temperatures, the diamond crystals may graphitize or form amorphous or glassy carbon at diamond crystal boundaries, which may substantially weaken the diamond table. Also, at extremely high temperatures, in addition to graphite and amorphous or glassy carbon, some of the diamond crystals may be converted to carbon monoxide and carbon dioxide. Accordingly, the substantially low annealing and hardening temperature at which the material of the low-carbon steel material 106 is hardened may facilitate forming the low-carbon steel material 106 without substantially damaging (e.g., graphitizing) or otherwise affecting the polycrystalline diamond material 102.

Carbon may constitute less than about 0.02 weight percent, such as less than about 0.015 weight percent, less than about 0.01 weight percent, or even less than about 0.005 weight percent of the low-carbon steel material 106. In some embodiments, the low-carbon steel material 106 comprises a maraging steel material. The low-carbon steel material 106 may comprise, for example, Grade 200 maraging steel, Grade 250 maraging steel, Grade 300 maraging steel, Grade 350 maraging steel, wherein the number indicates an approximate nominal tensile strength (in thousands of pounds per square inch) or other alloy of maraging steel.

In some embodiments, the low-carbon steel material 106 may comprise iron and nickel and one or more secondary alloying elements including cobalt, molybdenum, titanium, aluminum, manganese, or niobium. The low-carbon steel material 106 may include between about 15.0 weight percent and about 20.0 weight percent nickel, such as between about 17.0 weight percent and about 19.0 weight percent nickel, between about 5.0 weight percent and about 20.0 weight percent cobalt, such as between about 8.0 weight percent and about 12.5 weight percent cobalt, between about 2.0 weight percent and about 6.0 weight percent molybdenum, such as between about 3.0 weight percent and about 5.5 weight percent molybdenum, between about 0.1 weight percent and about 2.0 weight percent titanium, such as between about 0.15 weight percent and about 1.6 weight percent titanium and, in some embodiments, between about 0.05 weight percent and about 0.15 weight percent aluminum. In some embodiments, the low-carbon steel material 106 may include between about 17 weight percent and about 19.0 weight percent nickel, between about 8.0 weight percent and about 12.0 weight percent cobalt, between about 3.0 weight percent and about 5.0 weight percent molybdenum, and between about 0.2 weight percent and about 1.6 weight percent titanium. The remainder of the low-carbon steel material 106 may comprise iron.

Accordingly, the cutting element 100 may include the substrate 104, which may facilitate and catalyze formation of intergranular bonds between diamond particles in the polycrystalline diamond material 102 during sintering thereof, and may also include the low-carbon steel material 106, which may facilitate machining and shaping of the cutting element 100 to a desired size and shape for attachment to a drill bit. In some embodiments, a thickness of the low-carbon steel material 106 may be greater than a thickness of the substrate 104. By way of nonlimiting example, the low-carbon steel material 106 may have a thickness of about 10.16 mm (about 0.400 inch) while the substrate has a thickness of about 2.54 mm (about 0.100 inch). By way of comparison, conventional cutting elements may include a substrate comprising a carbide material (e.g., tungsten carbide) having a thickness of about 12.7 mm (about 0.500 inch) supporting a diamond table.

In some embodiments, the substrate 104 may have a thickness between about 0 mm and about 15 mm and the low-carbon steel material 106 may have a thickness between about 100 μm and about 10 mm such as between about 100 μm and about 500 μm, between about 500 μm and about 1 mm, or between about 1 mm and about 10 mm.

Figure 2:
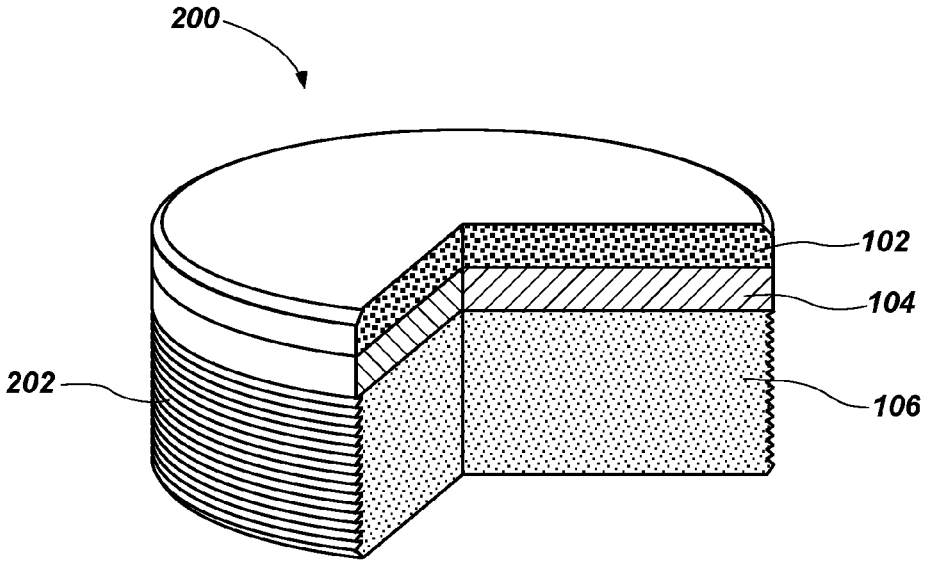
FIG. 2 is a partially cut-away perspective view of a polycrystalline diamond compact cutting element, in accordance with other embodiments of the disclosure.

In some embodiments, the low-carbon steel material 106 may be machined to form one or more of threads, one or more flats, one or more slots, or one or more other structures configured to facilitate attachment of the low-carbon steel material 106 to a bit body of a drill bit. In other words, the cutting element 100 may include one or more of threads, one or more flats, one or more slots, or one or more other structures formed in the low-carbon steel material 106. As will be described herein, the low-carbon steel material 106 may be machined prior to hardening the low-carbon steel material 106. By way of nonlimiting example and with reference to FIG. 2, a cutting element 200 is illustrated. The cutting element 200 includes threads 202 on at least a portion of the low-carbon steel material 106. The threads 202 may be formed on an outer portion of the low-carbon steel material 106 such that the cutting element 200 may be threadably attached to a drill bit. In some such embodiments, a corresponding bit body of a drill bit may comprise a threaded cavity or pocket configured to receive the cutting element 200.

Figure 3:
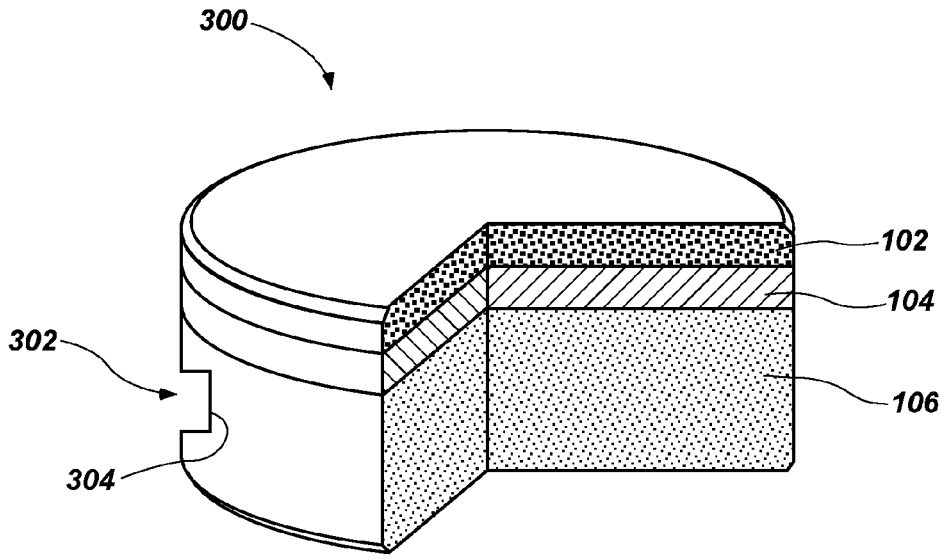
FIG. 3 is a partially cut-away perspective view of a polycrystalline diamond compact cutting element, in accordance with yet other embodiments of the disclosure.

FIG. 3 illustrates a cutting element 300 comprising a flat 302 in the low-carbon steel material 106 configured for receiving a set screw or other biasing means to secure the cutting element 300 to a drill bit. The flat 302 may comprise a substantially planar surface 304 configured to be engaged by a biasing member (e.g., a set screw).

Figure 4:
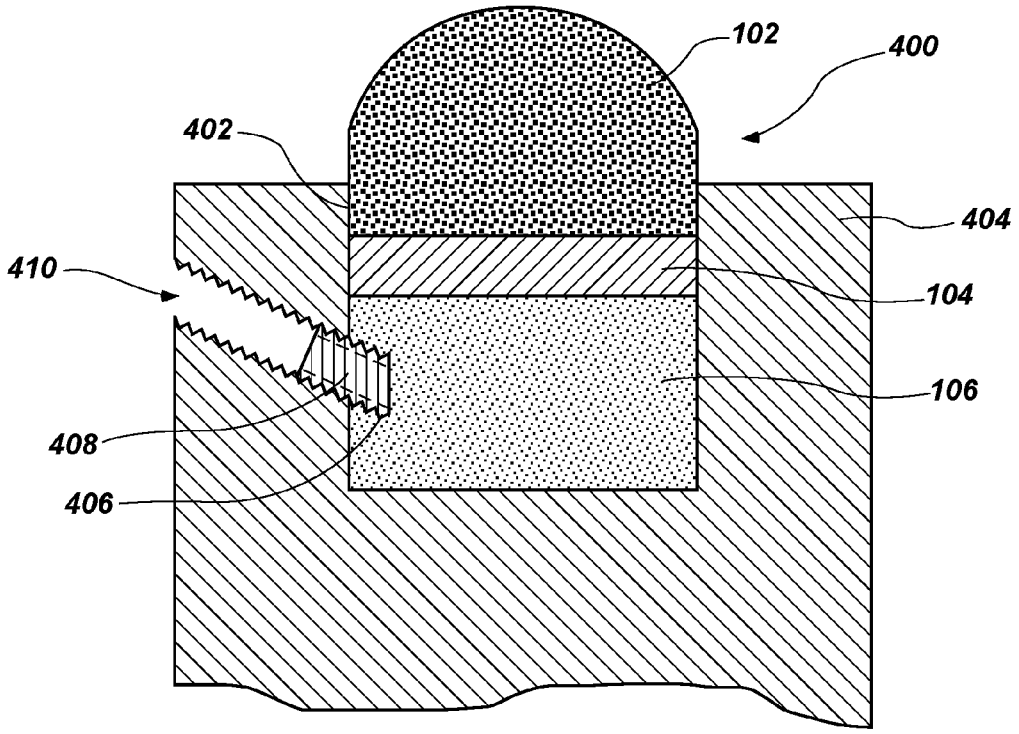
FIG. 4 is a partially cut-away perspective view of a polycrystalline diamond compact cutting element, in accordance with further embodiments of the disclosure.

FIG. 4 illustrates a cutting element 400 disposed in, for example, a pocket 402 of a blade 404 of an earth-boring tool. The low-carbon steel material 106 may comprise a threaded portion 406 configured to receive a set screw 408 through a tapped bore 410 extending through a body of the blade 404.

Figure 5A:
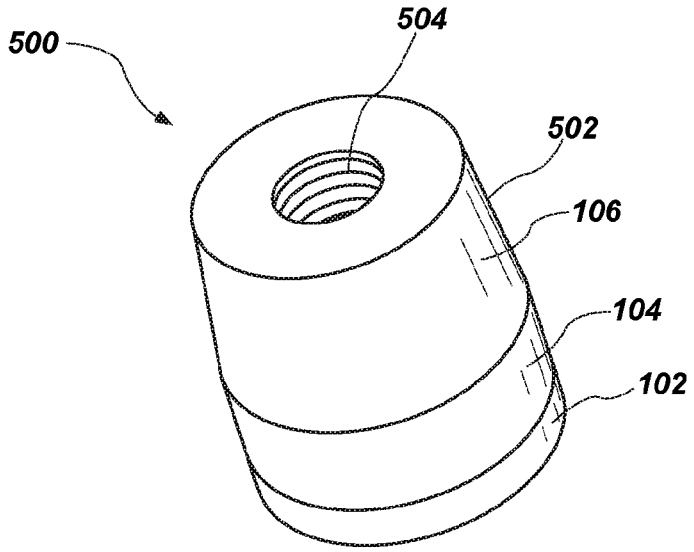
FIG. 5A and FIG. 5B are a respective perspective view and a cross-sectional view of a polycrystalline diamond compact cutting element, in accordance with other embodiments of the disclosure.
Figure 5B:
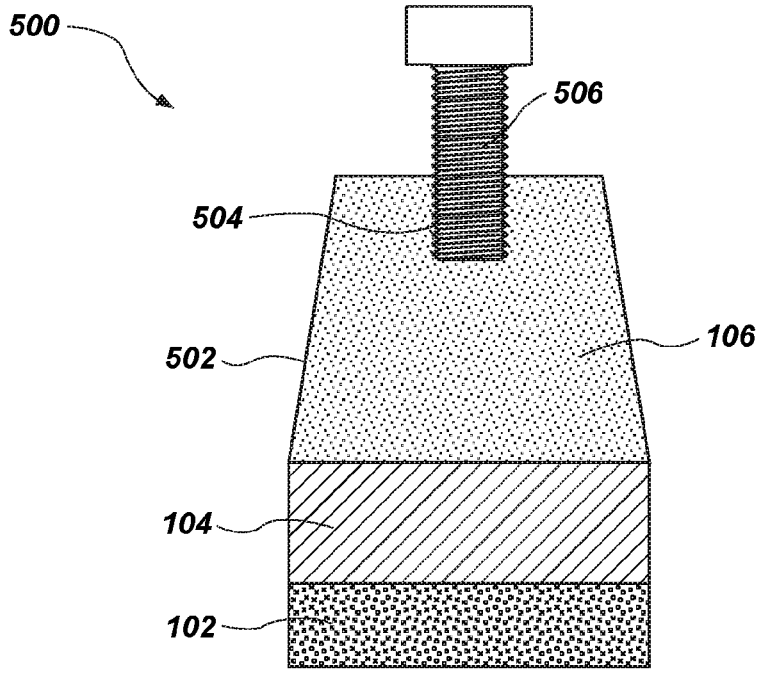

FIG. 5A and FIG. 5B are a respective perspective view and a cross-sectional view of a cutting element 500 configured to be disposed in a pocket of a blade of an earth-boring tool. The low-carbon steel material 106 may be machined to include a tapered surface 502 that may be configured to be received in a corresponding tapered surface of a pocket of a blade of an earth-boring tool. Of course, in other embodiments, the low-carbon steel material 106 may not include the tapered surface 502 and may comprise a surface substantially parallel with surfaces of the polycrystalline diamond material 102 and the substrate 104. An internal portion of the low-carbon steel material 106 may comprises threads 504 configured to receive, for example, a bolt 506. The bolt 506 may secure the cutting element 500 to an earth-boring tool. For example, the bolt 506 may extend from a back side of a blade to secure the cutting element 500 to a front side of the blade, as will be described with reference to FIG. 7.

In yet other embodiments, the low-carbon steel material 106 may comprise a slot (e.g., a t-slot, a dovetail joint, etc.) configured to retain the cutting element associated therewith to a drill bit. Other shapes and methods of mechanically attaching a cutting element to a drill bit may be apparent to those of ordinary skill in the art, such as those described and shown in U.S. Pat. No. 8,528,670, titled "CUTTING ELEMENT APPARATUSES AND DRILL BITS SO EQUIPPED," the entire disclosure of which is incorporated herein in its entirety by this reference.

Although FIG. 1 through FIG. 5B illustrate the substrate 104 between the low-carbon steel material 106 and the polycrystalline diamond material 102, the disclosure is not so limited. In some embodiments, the cutting element 100 may not include the substrate 104. In some such embodiments, the low-carbon steel material 106 may directly contact the polycrystalline diamond material 102. In some embodiments, the low-carbon steel material 106 may be formed between two different layers of the polycrystalline diamond material 102. Such a configuration may facilitate changing a position of the cutting element on an associated drill bit after a first side of the cutting element has worn a predetermined amount.

In yet other embodiments, the low-carbon steel material 106 may be formed on each of opposing sides of the polycrystalline diamond material 102. In further embodiments, the cutting element 100 may include a polycrystalline diamond material 102 over a low-carbon steel material 106, a substrate 104 over the low-carbon steel material 106, and another low-carbon steel material 106 over the substrate 104.

In some embodiments, the low-carbon steel material 106 of any of FIG. 1 through FIG. 5B may be coated with a hardfacing material including particles of a superhard material embedded in a metal matrix. The superhard material may comprise particles of one or more of tungsten carbide, titanium carbide, tantalum carbide, silicon carbide, titanium boride, silicon nitride, or other superhard material.

Figure 6:
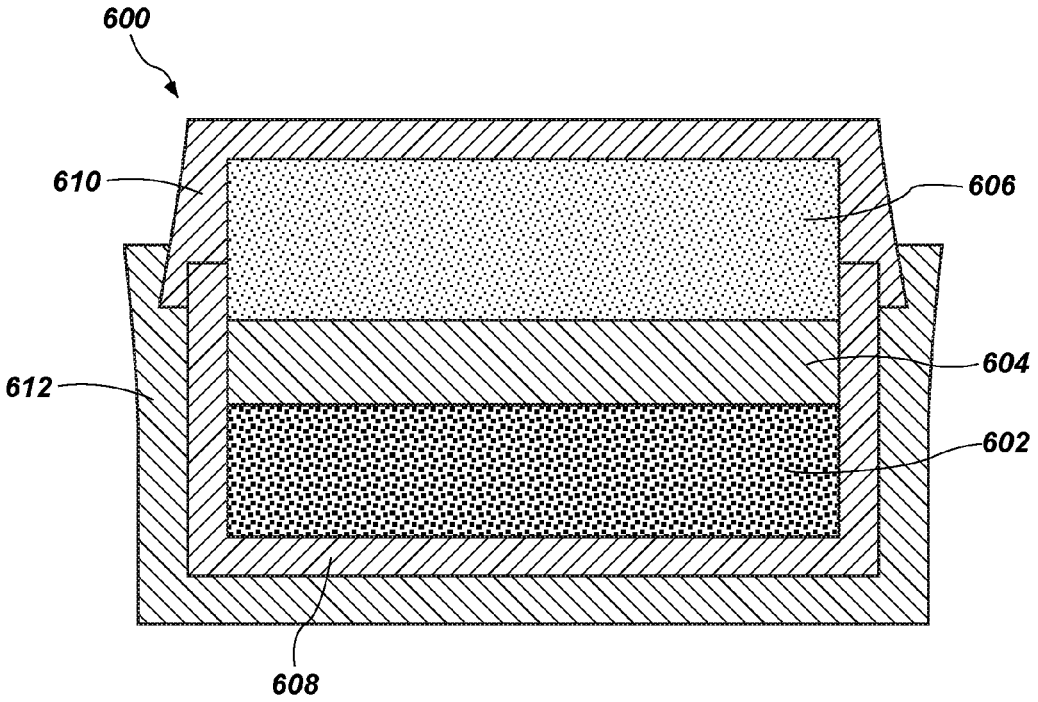
FIG. 6 is a simplified cross-sectional side view illustrating a method of forming a polycrystalline diamond compact, in accordance with embodiments of the disclosure.

In some embodiments, methods of forming the cutting element 100, 200, 300, 400, 500 may include HPHT sintering of a plurality of materials that form the cutting element. Referring to FIG. 6, a mixture comprising diamond particles 602 and, optionally, a metal solvent catalyst material may be placed in a container 600 (e.g., a metal canister). The metal solvent catalyst material may include, for example, cobalt, iron, nickel, or combinations thereof. In some embodiments, the diamond particles 602 may not include the metal solvent catalyst and the metal solvent catalyst may be provided in a substrate 604, which may also be provided in the container 600. The metal solvent catalyst may sweep through the polycrystalline diamond material during sintering thereof.

A powder 606 having a composition of the low-carbon steel may be provided in the container 600 on a side of the substrate 604 opposite a side of the substrate 604 in contact with the diamond particles 602. The powder 606 may directly contact the substrate 604. The powder 606 may comprise the same material as the low-carbon steel material 106 (FIG. 1) prior to hardening thereof. In some embodiments, the powder 606 comprises maraging steel. The powder 606 may have a carbon content less than about 0.02 weight percent.

Although the powder 606 has been described as being on a side of the substrate 604, the disclosure is not so limited. For example, as described above, a cutting element may include a low-carbon steel material directly contacting a polycrystalline diamond material. In some such embodiments, the powder 606 may be disposed in direct contact with the diamond particles 602 and the container 600 may not include the substrate 604. In other embodiments, the powder 606 may be disposed directly between two layers of diamond particles 602 to form a cutting element including a low-carbon steel material directly between layers of a polycrystalline diamond material. In yet other embodiments, a low-carbon steel material may be formed on each of opposing sides of a polycrystalline diamond material to form a cutting element including a polycrystalline material with a low-carbon steel material on opposing sides thereof. In embodiments including more than one portion of a low-carbon steel material 106, each portion of the low-carbon steel material 106 may be machined as described herein.

In some embodiments, the powder 606 may comprise a mixture including particles of iron and nickel and one or more of cobalt, molybdenum, titanium, aluminum, manganese, or niobium provided in proportions equal to a proportions of such materials in the maraging steel material 106 (FIG. 1). By way of nonlimiting example, the powder may comprise between about 15.0 weight percent and about 20.0 weight percent nickel, between about 5.0 weight percent and about 20.0 weight percent cobalt, between about 2.0 weight percent and about 6.0 weight percent molybdenum, between about 0.1 weight percent and about 2.0 weight percent titanium, and, in some embodiments, between about 0.05 weight percent and about 0.15 weight percent aluminum. A remainder of the powder 606 may comprise iron.

The container 600 may include an inner cup 608 in which the diamond particles 602 are provided. In some embodiments, the substrate 604 may be provided in the inner cup 608 over or under the diamond particles 602, and may ultimately be encapsulated in the container 600. The container 600 may further include a top cover 610 and a bottom cover 612, which may be assembled and bonded together (e.g., swage bonded) around the inner cup 608 with the diamond particles 602, the substrate 604, and the powder 606 therein.

In some embodiments, the container 600, including the diamond particles 602, the substrate 604, and the powder 606 therein may be subjected to an HPHT process to form a polycrystalline diamond material from the diamond particles 602 and a sintered low-carbon steel material from the powder 606. By way of nonlimiting example, the container 600 may be subjected to a pressure of at least about 5.5 GPa and a temperature of at least about 1,000° C. In some embodiments, the container 600 may be subjected to a pressure of at least about 6.0 GPa, or even at least about 6.5 GPa. For example, the container 600 may be subjected to a pressure from about 5.5 GPa to about 10.0 GPa, or from about 6.5 GPa to about 8.0 GPa. The container 600 may be subjected to a temperature of at least about 1,100° C., at least about 1,200° C., at least about 1,300° C., at least about 1,400° C., or even at least about 1,500° C. HTHP conditions may be maintained for a period of time from about 30 seconds to about 60 minutes to sinter diamond particles 602 as well as the powder 606. During sintering, the diamond particles 602 may be sintered to a first side of the substrate 604 so as to form a polycrystalline diamond material on the first side of the substrate 604 and particles of the powder 606 may be sintered and bonded to a second, opposite side of the substrate 604 so as to form a low-carbon steel material on the second side of the substrate 604. In other words, sintering may bond the diamond particles 602 to each other and to the substrate 604, forming a layer of polycrystalline diamond (PCD). In addition, sintering may bond particles of the powder 606 to each other and to the substrate 604, forming a layer of a low-carbon steel material, which may subsequently be hardened to form the low-carbon steel material 106 (FIG. 1).

Accordingly, in some embodiments, the low-carbon steel material may be directly formed (e.g., sintered) in a structure that will comprise a cutting element. The low-carbon steel material may be sintered and bonded directly to a side of the substrate 604 such that the low-carbon steel material directly contacts the substrate 604.

Without wishing to be bound by any particular theory, selecting the powder 606 to comprise a low-carbon steel material facilitates sintering of the low-carbon steel material to form a hardenable material directly on and in contact with the substrate 604 without forming cracks in the low-carbon steel material. By way of contrast, materials including a higher carbon-content (e.g., AISI 4140 steel, AISI 1018 steel, AISI 1040 steel, UNS S17400 alloy, etc.) may be formed with cracks when sintered. It is believed that since the powder 606 comprises a substantially low carbon content, a significant amount of carbide materials are not formed in the resulting low-carbon steel material during sintering of the powder 606. It is believed that the carbon in steel materials such as AISI 4140 steel, AISI 1018 steel, AISI 1040 steel, UNS S17400 alloy, or other grades or alloys of steel form carbides during sintering thereof, which may form cracks in sintered structures. In addition, it is believed that the low carbon content of the powder 606 increases a melting temperature of the powder 606 and substantially reduces an amount of the powder 606 that melts during the sintering process and, therefore, increases a pressure to which the powders in the container 600 are exposed. The increased pressure facilitates formation of a polycrystalline diamond material having improved properties compared to a polycrystalline diamond material formed at lower pressures.

After sintering the diamond particles 602, at least a portion of the metal solvent catalyst material may be removed from the interstitial spaces in the polycrystalline diamond material to form an at least partially leached polycrystalline compact, as known by those of ordinary skill in the art.

Removal of the metal solvent catalyst material may be performed by conventional means, such as by placing the polycrystalline diamond material in an acid bath. Such a process may be referred to in the art as leaching, or acid-leaching. By way of example and not limitation, the polycrystalline diamond material may be leached using a leaching agent such as aqua regia (a mixture of concentrated nitric acid ($HNO_3$) and concentrated hydrochloric acid (HCl)) to at least substantially remove the metal solvent catalyst material from the interstitial spaces between inter-bonded diamond grains in the polycrystalline diamond material. In other embodiments, the leaching agent may include boiling hydrochloric acid and boiling hydrofluoric acid (HF).

After leaching the polycrystalline diamond material, at least some of the interstitial spaces between the inter-bonded diamond grains within the polycrystalline diamond material may be at least substantially free of the metal solvent catalyst material. At least a portion of the polycrystalline diamond material may include the metal solvent catalyst material (e.g., portions that are not leached, such as portions that are away from cutting faces of the polycrystalline diamond material).

After leaching the polycrystalline diamond material, the low-carbon steel material may be machined (e.g., sized and shaped) to a desired configuration. Selecting the powder 606 to exhibit a composition of a low-carbon steel material may facilitate machining the low-carbon steel material prior to hardening the maraging steel material. In some embodiments, the low-carbon steel material may be machined to include a means for attaching a cutting element including the low-carbon steel material 106 (FIG. 1 through FIG. 5B) to a drill bit. By way of nonlimiting example, one or more of threads, one or more flats, one or more slots, or other means for attaching a cutting element to a drill bit may be machined in the low-carbon steel material, as described above with reference to FIG. 2 through FIG. 5B.

After the low-carbon steel material is machined, the low-carbon steel material may be annealed and aged. As described above, the low-carbon steel material may comprise a material that may be machined while in a soft state and may be heat treated after machining thereof. In some embodiments, the low-carbon steel material may comprise a material that may be annealed and aged at substantially low temperatures such that the polycrystalline diamond material, the substrate 604, or both are not substantially changed (e.g., damaged) responsive to exposure to such temperatures.

In some embodiments, the low-carbon steel material is exposed to a temperature less than about 900° C., such as between about 800° C. and about 900° C. to anneal the low-carbon steel material. In some embodiments, the low-carbon steel material is annealed at a temperature of about 820° C. for a duration between about 30 minutes and about 2 hours, depending on a thickness of the low-carbon steel material. After annealing the low-carbon steel material, the low-carbon steel material may be slowly cooled to, for example, room temperature, such as by air cooling.

After the low-carbon steel material is annealed, the material may be exposed to a temperature between about 450° C. and about 500° C. for between about 2 hours and about 4 hours, such as about 3 hours to age and harden the low-carbon steel material and form a dispersion of $Ni_3(X,Y)$ intermetallic phases therein, wherein X and Y are solute elements added for precipitation (such as, for example, cobalt, molybdenum, titanium, aluminum, manganese, or niobium). Accordingly, the low-carbon steel material 106 (FIG. 1 through FIG. 5B) may include one or more metallic precipitates. In some embodiments, the metallic precipitates are selected from the group consisting of cobalt, molybdenum, titanium, aluminum, manganese, and niobium.

During aging, the low-carbon steel material does not substantially change in size and shape. In other words, the low-carbon steel material may be machined to a desired final size and a final shape prior to annealing and aging the low-carbon steel material to form the low-carbon steel material 106. Aging the low-carbon steel material may form the low-carbon steel material 106 and the corresponding cutting element 100, 200, 300, 400, 500 as described above with reference to FIG. 1 through FIG. 5B.

Figure 7:
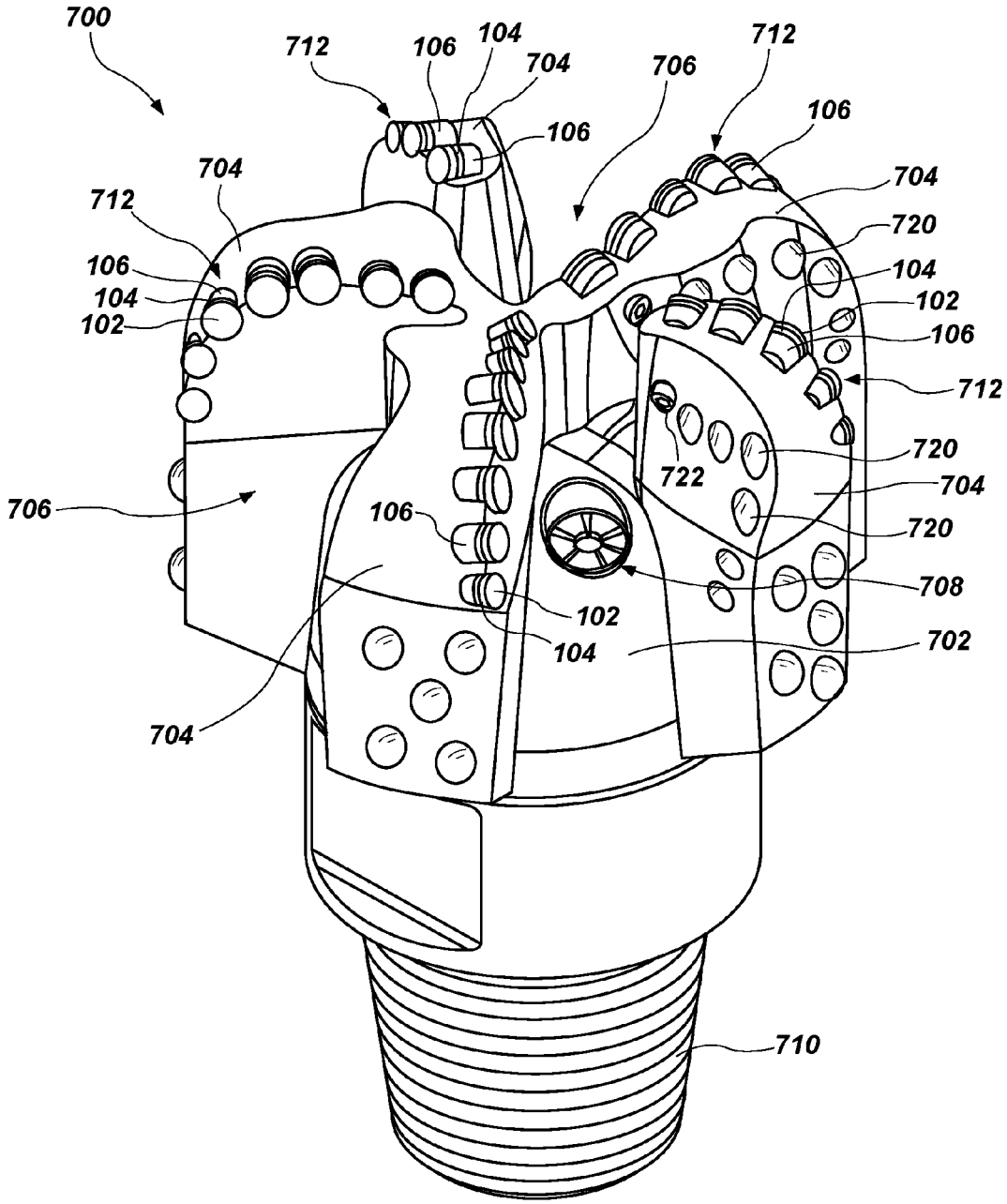
FIG. 7 is a perspective view of an embodiment of a fixed-cutter earth-boring rotary drill bit that includes a plurality of cutting elements like any of the polycrystalline diamond compacts illustrated in FIG. 1 through FIG. 5B, in accordance with embodiments of the disclosure.

The cutting elements 100, 200, 300, 400, 500, including the heat treated and hardened low-carbon steel material 106, may be mechanically affixed to an earth-boring rotary drill bit. FIG. 7 is a perspective view of an earth-boring tool in the form of a fixed-cutting rotary drill bit 700. The drill bit 700 may include a bit body 702 comprising a metal or metal alloy. In some embodiments, the bit body 702 may comprise an iron-based alloy, such as steel. In other embodiments, the bit body 702 may comprise a tungsten carbide matrix including tungsten carbide particles dispersed in a binder material. The bit body 702 may comprise a plurality of radially and longitudinally extending blades 704. A plurality of fluid channels 706, also referred to in the art as "junk slots" may be defined between the blades 704. The fluid channels 706 may extend over the bit body 702 between the blades 704. During drilling, drilling fluid may be pumped from the surface of the formation down the wellbore through a drill string to which the drill bit 700 is coupled, through the drill bit 700 and out fluid ports 708 in the bit body 702. The drilling fluid may then flow across the face of the drill bit 700, through the fluid channels 706, to the annulus of the drill pipe and the wellbore and flow back up through the wellbore to the surface of the formation. The drilling fluid may be circulated in this manner during drilling to flush cuttings away from the drill bit and up to the surface of the formation, and to cool the drill bit 700 and other equipment in the drill string.

The drill bit 700 may include a connection end 710 that is adapted for coupling of the drill bit to drill pipe or another component of a bottom hole assembly. The connection end 710 may comprise, for example, a threaded pin.

As shown in FIG. 7, the drill bit 700 may further include a plurality of cutting elements 712. The cutting elements 712 may be mounted on each of the blades 704 of the bit body 702. The cutting elements 712 may be substantially similar to any of the cutting elements 100, 200, 300, 400, 500 described above with reference to FIG. 1 through FIG. 5B. Accordingly, the cutting elements 712 may include the low-carbon steel material 106 including one or more of threads, flats, slots, or other mechanical structure configured to attach the cutting element 712 to the bit body 702 of the drill bit 700. By way of nonlimiting example, the cutting elements 712 may be substantially similar to the cutting elements 500 described above with reference to FIG. 5A and FIG. 5B. In some such embodiments, the cutting elements 712 may be bolted to the blades 704 of the drill bit 700. By way of nonlimiting example, a rotationally-trailing side of the blades 704 may include an opening 720 configured to receive a bolt 722 to removably attach the cutting elements 712 to the blades 704. The bolt 722 may extend from a rotationally-trailing side of the blade 704 to a rotationally-leading side of the blade 704 to secure the cutting elements 712 to the bit body 702. In some embodiments, the cutting elements 712 may be secured to the bit body 702 such that the low-carbon steel material 106 is located adjacent the substrate 104 and rotationally behind (relative to a direction of rotation of the drill bit 700 during drilling) the polycrystalline diamond material 102 with which it is respectively associated.

Accordingly, since the cutting elements 712 include at least a portion of the low-carbon steel material 106 having one or more of threads, one or more flats, or one or more slots, the cutting elements 712 may be removably attached to the bit body 702. The threads, flats, or slots may facilitate easy replacement of damaged or worn cutting elements 712.

It is contemplated that in some embodiments, the low-carbon steel material 106 may not include threads, one or more flats, or one or more slots. In some such embodiments, the low-carbon steel material 106 may be machined prior to hardening thereof such that the low-carbon steel material 106 exhibits a desired size and shape after hardening thereof. In some such embodiments, the cutting element 712 may be press fit, interference fit, or otherwise secured to the bit body 702. In some embodiments, the cutting elements 712 may be brazed to the bit body 702. In other embodiments, the cutting elements 712 may be welded to the bit body 702. For example, the low-carbon steel material 106 may be welded to the bit body 702.

Forming the low-carbon steel material 106 from a material having a low-carbon content (e.g., less than about 0.02 weight percent) may facilitate forming a low-carbon steel material from a material exhibiting good machinability while in a soft state. Since the low-carbon steel material may exhibit substantially no dimensional change responsive to heat treatment (e.g., annealing and aging), the low-carbon steel material may be machined to a near net shape of the low-carbon steel material 106 prior to hardening thereof. While in the soft state, the low-carbon steel material may exhibit a Rockwell C hardness (HRc) between about 28 and about 36. In some embodiments, the low-carbon steel exhibits a Rocwell C hardness of about 35 while in a soft state. After aging the low-carbon steel material to form the low-carbon steel material 106 (FIG. 1 through FIG. 5B), the low-carbon steel material 106 may have a Rockwell C hardness value between about 43 and about 60, such as between about 50 and about 60. In some embodiments, the low-carbon steel material 106 exhibits a Rockwell C hardness of about 55 after aging. Accordingly, the aged low-carbon steel material 106 may exhibit a substantially greater hardness than the low-carbon steel material in a soft state.

In addition, since the low-carbon steel material 106 may be hardened at temperatures as low as about 900° C. or lower, the low-carbon steel material 106 may be hardened while directly attached to a substrate disposed between the low-carbon steel material 106 and a polycrystalline diamond material or directly to a polycrystalline diamond material without substantially degrading the polycrystalline diamond material or an associated substrate, such as by, for example, graphitizing the polycrystalline diamond material.

Cutting elements formed according to embodiments described herein may be substantially free of a braze material (e.g., copper, silver, titanium, etc.) between the substrate 104 and the low-carbon steel material 106 or between the low-carbon steel material 106 and a polycrystalline diamond material 102. By way of contrast, prior art cutting elements including a steel material may include a braze material between the steel material and a substrate. The brazing process may expose the polycrystalline diamond table to elevated temperatures that may undesirably damage the integrity of the polycrystalline diamond table. In addition, the cutting elements described above, may be secured to the drill bit 700 (FIG. 7) without a braze material since the low-carbon steel material 106 includes machined surfaces configured for securing the cutting elements to the drill bit 700.

Although the cutting elements described above have been described as comprising a polycrystalline diamond compact (PDC), the disclosure is not so limited. In other embodiments, the cutting elements may comprise superhard or superabasive materials other than, or in addition to, a polycrystalline diamond material. By way of nonlimiting example, the cutting elements may comprise particles of cubic boron nitride (CBN) or other superhard or superabrasive materials.

Additional nonlimiting example embodiments of the present disclosure are set forth below.

Embodiment 1

A method of forming a cutting element, the method comprising: disposing diamond particles in a container;

disposing a metal powder on a side of the diamond particles; and sintering the diamond particles and the metal powder so as to form a polycrystalline diamond material and a low-carbon steel material, the low-carbon steel material comprising less than 0.02 weight percent carbon and an intermetallic precipitate on a side of the polycrystalline diamond material.

Embodiment 2

The method of Embodiment 1, wherein: disposing diamond particles in a container comprises disposing the diamond particles on a first side of a substrate in the container; disposing a metal powder on a side of the diamond particles comprises disposing the metal power on a second, opposite side of the substrate; and sintering the diamond particles and the metal powder comprises sintering the diamond particles to the first side of the substrate so as to form the polycrystalline diamond material on the first side of the substrate and sintering the metal powder to the second side of the substrate so as to form the low-carbon steel material on the second side of the substrate.

Embodiment 3

The method of Embodiment 1 or Embodiment 2, further comprising machining at least a portion of the low-carbon steel material and forming at least one of threads, at least one flat, or at least one slot in the low-carbon steel material.

Embodiment 4

The method of any one of Embodiments 1 through 3, further comprising hardening the low-carbon steel material after machining at least a portion thereof.

Embodiment 5

The method of Embodiment 4, wherein hardening the low-carbon steel material comprises exposing the low-carbon steel material to a temperature between about 500° C. and about 900° C.

Embodiment 6

The method of any one of Embodiments 1 through 5, further comprising selecting the low-carbon steel material to comprise: between about 15.0 weight percent and about 20.0 weight percent nickel; between about 5.0 weight percent and about 20.0 weight percent cobalt; between about 2.0 weight percent and about 6.0 weight percent molybdenum; and between about 0.1 weight percent and about 2.0 weight percent titanium.

Embodiment 7

The method of any one of Embodiments 1 through 6, further comprising selecting the low-carbon steel to comprise less than about 0.01 weight percent carbon.

Embodiment 8

A cutting element, comprising: a polycrystalline diamond material; and low-carbon steel material comprising less than about 0.02 weight percent carbon on at least a side of the polycrystalline diamond material, the low-carbon steel material comprising at least one machined surface.

Embodiment 9

The cutting element of Embodiment 8, w further comprising a substrate between the low-carbon steel material and the polycrystalline diamond material, the low-carbon steel material directly contacting the substrate.

Embodiment 10

The cutting element of Embodiment 9, wherein an interface between the substrate and the low-carbon steel material is substantially free of a braze material.

Embodiment 11

The cutting element of any one of Embodiments 8 through 10, further comprising another polycrystalline diamond material on a side of the low-carbon steel material opposite the polycrystalline diamond material.

Embodiment 12

The cutting element of any one of Embodiments 8 through 11, further comprising another low-carbon steel material on at least another side of the polycrystalline diamond material.

Embodiment 13

The cutting element of any one of Embodiments 8 through 12, wherein the low-carbon steel material comprises less than about 0.01 weight percent carbon.

Embodiment 14

The cutting element of any one of Embodiments 8 through 13, further comprising a hardfacing material on at least one surface of the low-carbon steel material.

Embodiment 15

The cutting element of any one of Embodiments 8 through 14, wherein the low-carbon steel material comprises maraging steel including between about 15.0 weight percent and about 20.0 weight percent nickel.

Embodiment 16

The cutting element of Embodiment 15, wherein the low-carbon steel material comprises: between about 5.0 weight percent and about 20.0 weight percent cobalt; between about 2.0 weight percent and about 6.0 weight percent molybdenum; and between about 0.1 weight percent and about 2.0 weight percent titanium.

Embodiment 17

The cutting element of any one of Embodiments 8 through 16, wherein the low-carbon steel material comprises at least one metallic precipitate.

Embodiment 18

The cutting element of any one of Embodiments 8 through 17, wherein the at least one machined surface comprises a structure having one or more of a threaded connection, at least one flat, or at least one slot configured to couple the cutting element to the bit body formed in the low-carbon steel material.

Embodiment 19

An earth-boring tool, comprising: a bit body including at least one blade; and at least one cutting element mechanically attached to the bit body, the at least one cutting element comprising: a polycrystalline diamond material; and a low-carbon steel material comprising less than about 0.02 weight percent carbon on at least one side of the polycrystalline diamond material.

Embodiment 20

The earth-boring tool of Embodiment 19, wherein the at least one cutting element is mechanically attached to the bit body with one of threads, at least one flat, or at least one slot formed in the low-carbon steel material.

While the disclosure is susceptible to various modifications and alternative forms, specific embodiments have been shown by way of example in the drawings and have been described in detail herein. However, the disclosure is not intended to be limited to the particular forms disclosed. Rather, the disclosure is to cover all modifications, equivalents, and alternatives falling within the scope of the disclosure as defined by the following appended claims and their legal equivalents.

What is claimed is:

1. A method of forming a cutting element, the method comprising:

disposing diamond particles in a container;

disposing a metal powder on a side of the diamond particles; and sintering the diamond particles and the metal powder so as to form a polycrystalline diamond material and a low-carbon steel material, the low-carbon steel material comprising less than 0.02 weight percent carbon and an intermetallic precipitate on a side of the polycrystalline diamond material.

2. The method of claim 1, wherein:

disposing diamond particles in a container comprises disposing the diamond particles on a first side of a substrate in the container;

disposing a metal powder on a side of the diamond particles comprises disposing the metal power on a second, opposite side of the substrate; and sintering the diamond particles comprises sintering the diamond particles to the first side of the substrate so as to form the polycrystalline diamond material on the first side of the substrate and sintering the metal powder to the second side of the substrate so as to form the low-carbon steel material on the second side of the substrate.

3. The method of claim 1, further comprising machining at least a portion of the low-carbon steel material and forming at least one of threads, at least one flat, or at least one slot in the low-carbon steel material.

4. The method of claim 1, further comprising hardening the low-carbon steel material after machining at least a portion thereof.

5. The method of claim 1, further comprising selecting the low-carbon steel material to comprise:

between about 15.0 weight percent and about 20.0 weight percent nickel;

between about 5.0 weight percent and about 20.0 weight percent cobalt;

between about 2.0 weight percent and about 6.0 weight percent molybdenum; and between about 0.1 weight percent and about 2.0 weight percent titanium.

6. The method of claim 1, further comprising selecting the low-carbon steel to comprise less than about 0.01 weight percent carbon.

7. A cutting element, comprising:

a polycrystalline diamond material; and low-carbon steel material comprising less than about 0.02 weight percent carbon on at least a side of the polycrystalline diamond material, the low-carbon steel material comprising at least one machined surface.

8. The cutting element of claim 7, further comprising a substrate between the low-carbon steel material and the polycrystalline diamond material, the low-carbon steel material directly contacting the substrate.

9. The cutting element of claim 8, wherein an interface between the substrate and the low-carbon steel material is free of a braze material.

10. The cutting element of claim 7, further comprising another polycrystalline diamond material on a side of the low-carbon steel material opposite the polycrystalline diamond material.

11. The cutting element of claim 7, further comprising another low-carbon steel material on at least another side of the polycrystalline diamond material.

12. The cutting element of claim 7, wherein the low-carbon steel material comprises less than about 0.01 weight percent carbon.

13. The cutting element of claim 7, further comprising a hardfacing material on at least one surface of the low-carbon steel material.

14. The cutting element of claim 7, wherein the low-carbon steel material comprises maraging steel including between about 15.0 weight percent and about 20.0 weight percent nickel.

15. The cutting element of claim 14, wherein the low-carbon steel material comprises:

between about 5.0 weight percent and about 20.0 weight percent cobalt;

between about 2.0 weight percent and about 6.0 weight percent molybdenum; and between about 0.1 weight percent and about 2.0 weight percent titanium.

16. The cutting element of claim 7, wherein the low-carbon steel material comprises at least one metallic precipitate.

17. The cutting element of claim 7, wherein the at least one machined surface comprises a structure having one or more of a threaded connection, at least one flat, or at least one slot configured to couple the cutting element to the bit body formed in the low-carbon steel material.

18. The cutting element of claim 7, further comprising a substrate between the low-carbon steel material and the polycrystalline diamond material, wherein a thickness of the low-carbon steel material is greater than a thickness of the substrate.

19. An earth-boring tool, comprising:

a bit body including at least one blade; and at least one cutting element mechanically attached to the bit body, the at least one cutting element comprising: a polycrystalline diamond material; and a low-carbon steel material comprising less than about 0.02 weight percent carbon on at least one side of the polycrystalline diamond material.

20. The earth-boring tool of claim 19, wherein the at least one cutting element is mechanically attached to the bit body with one of threads, at least one flat, or at least one slot formed in the low-carbon steel material.

* * * * *